US006036610A

United States Patent [19]

Lewark

[11] Patent Number: 6,036,610

[45] Date of Patent: Mar. 14, 2000

[54] REINFORCED BASEBALL BAT

[75] Inventor: Blaise A. Lewark, Escondido, Calif.

[73] Assignee: Anderson-Bridges Interests, Inc., San Diego, Calif.

[21] Appl. No.: 09/259,574

[22] Filed: Mar. 1, 1999

[51] Int. Cl.[7] ..... A63B 59/06

[52] U.S. Cl. ..... 473/564

[58] Field of Search ..... 473/564–568, 473/561, 535, 536, 457

[56] References Cited

U.S. PATENT DOCUMENTS 3,129,003 4/1964 Mueller et al. ..... 473/564

4,848,745 7/1989 Bohannan et al. ..... 473/567

*Primary Examiner*—Mark S. Graham

*Attorney, Agent, or Firm*—Stanley A. Becker

[57] ABSTRACT

A baseball bat which has a reinforced handle portion and an enhanced gripping surface. A biaxially braided tubular overlay member which is formed from a hybrid of carbon fibers and aramid fibers is laminated to the handle portion of the bat. The overlay member has a modulus of elasticity greater than the modulus of elasticity of the bat. The overlay member strengthens the bat without substantially changing the performance characteristics of the bat.

11 Claims, 3 Drawing Sheets

REINFORCED BASEBALL BAT

BACKGROUND OF THE INVENTION

1. Field of the Invention

This invention relates to baseball bats having a braided hybrid composite overlay laminated to the handle to provide an enhanced gripping surface and to strengthen the bat. The composite overlay does not alter the feel or playing characteristics of the bat in any way, and conforms to all regulations regarding use of the bat in major, minor and NCAA leagues.

It is well known that bats, particularly in the major leagues, last a relatively short period of time. They are either broken in practice or in play and serious consequences result if someone is hit with the fly away portion of a bat. Injuries can occur, not only to players, but to the fans. Bats might fail on the first hit or may last for many months, depending on how often they are used. The cost for replacement of such bats is relatively large. More importantly, the possibility of reducing injury to others by providing an unbreakable bat is highly desired.

Aluminum bats have been adopted in the National Federation of State High School Associations and the NCAA for a long period of time as the alternative to wood bats. This alternative has been successful primarily because one aluminum bat could be used by an entire team or for an entire season, thus saving money. However, players are being hurt with the aluminum bats since the ball comes off the bat much faster than it does off a wood bat. Consequently, there is a movement to change the specifications of aluminum bats to make it perform more like wood bats. Aluminum bats were never permitted in the major leagues.

2. Description of Related Art

U.S. Pat. No. 3,129,003 discloses a baseball bat with a reinforced handle having a woven sleeve of glass fibers laminated to the bat handle, with the sleeve having a modulus of elasticity substantially the same as the bat.

U.S. Pat. No. 4,012,039 discloses a slip resistant covering for the overlapping portion of a baseball bat.

U.S. Pat. No. 2,984,486 discloses a slip proof sleeve for the grip of a baseball bat.

U.S. Pat. Nos. 1,617,972, 1,701,856, 1,917,795, 3,147,012, 5,343,776 and 5,653,646 all disclose grips for golf clubs.

U.S. Pat. No. 5,343,776 discloses a handle grip cover formed with a knitted, braided or woven tubular shaped material impregnated with a synthetic or natural elastomer. The grip cover may be applied to a tool or piece of athletic equipment which is gripped by the hand.

U.S. Pat. No. 3,115,912 discloses a tool handle which has a resin impregnated fabric sleeve laminated thereto.

U.S. Pat. No. 4,148,482 discloses a hockey stick with a reinforcing material or fiberglass, polyester or polyamide yarn laminated to the impact area of the stick with a resinous coating.

None of the prior art describes a bat having a tubular braided hybrid composite overlay member which is made of carbon and aramid fibers laminated and cured with a thermosetting resin matrix to form a strengthened bat having an enhanced gripping surface.

SUMMARY OF THE INVENTION

The present invention provides a baseball bat which is reinforced to provide a stronger bat that will not break and has an enhanced gripping surface. The bat is reinforced in a manner that does not change the performance characteristics of the bat. The present invention provides a reinforcing system which strengthens the bat so that it will not break in normal play, or if it does break, will retain the barrel portion from flying off and injuring someone, and further provides an enhanced gripping surface for the batter. The invention is based upon utilization of a biaxially braided tubular overlay member which is formed from a plurality of carbon fibers with a plurality of aramid fibers. The overlay has a modulus of elasticity greater than the modulus of elasticity of the bat. This combination provides unexpected strength properties to the bat without substantially changing the performance characteristics of the bat.

The baseball bat in accordance with this invention has a tubular biaxially braided overlay member laminated to the handle portion of the bat extending from the knob no more than 18 inches toward the barrel of the bat. The overlay member is biaxially braided from a plurality of carbon fibers and aramid fibers. Preferably, the carbon fibers and aramid fibers alternate in sequence. Preferably, the bias of the fibers is approximately ±45 degrees to the longitudinal axis of the bat, and within the range of ±30 degrees to ±60 degrees to the longitudinal axis of the bat. The overlay member is laminated to the handle of the bat with a thermosetting resin matrix. The bat is cured for a predetermined period to harden the resin matrix and bond the overlay member securely to the handle. The resultant bat cannot be broken except with the application of abnormal forces. It is not believed that a bat can be broken in play. However, if a bat were to break in play due to a defect in the wood or for any other reason, it is believed that the aramid fibers of the overlay member would not fracture due to its high tensile strength and high elongation at break and would therefore hold the broken portion of the bat to the handle portion so that it would not fly away and injure a player or a spectator.

DETAILED DESCRIPTION OF THE PREFERRED EMBODIMENTS

The following description is of the best currently contemplated mode for carrying out the invention. This description is made for the purpose for illustrating the general principles of the invention and should not be taken in a limited sense.

Figure 1:
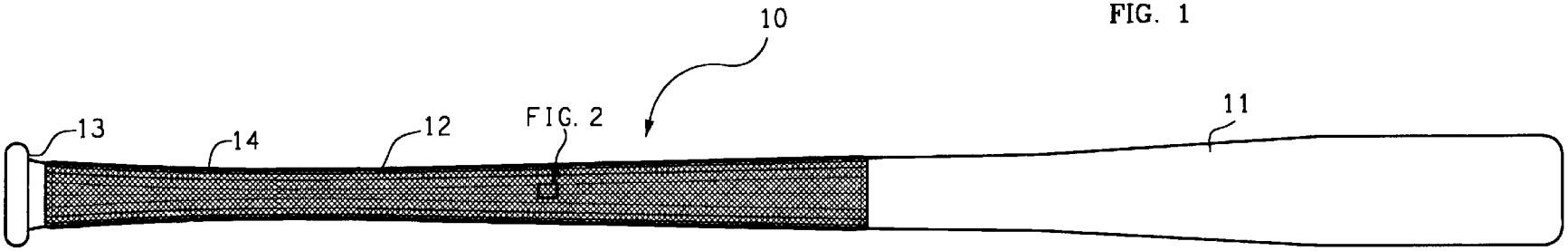
FIG. 1 is a plan view of a baseball bat having an overlay member laminated to the grip in accordance with the principles of this invention.

In accordance with the present invention there is shown in FIG. 1 a baseball bat generally designated as 10, having a barrel or hitting portion 11, a grip or handle portion 12 and a knob 13 at the free end of the grip. A braided tubular hybrid composite overlay member 14 is laminated to the handle 12. The member 14 is a biaxially braided or woven tubular shaped member made from a plurality of carbon fibers 16 and aramid fibers 17 which are braided together. Preferably the overlay member 14 is braided with 50% of the fibers being carbon and 50% of the fibers being aramid. Other combinations of carbon fiber and aramid fiber may work equally well. The overlay member 14 should be no longer than 18 inches, which is the maximum span allowable by major league baseball to enhance the grip surface of the handle.

Figure 2:
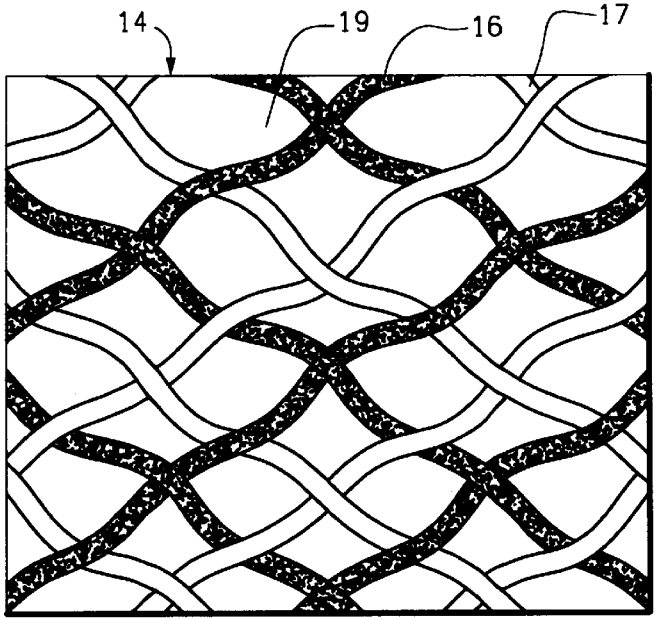
FIG. 2 is an exploded plan view of a portion of a tubular composite braided overlay member in accordance with the principles of this invention.

Referring to FIG. 2 there is shown an exploded view of a portion of the hybrid composite overlay member 14. The member 14 has a plurality of alternating biaxially oriented carbon fibers 16 shown in black, alternating with aramid fibers 17 shown in white. The interstices or openings 19 between the fibers allow resin matrix material 18 to be applied to the overlay 14 to contact the handle 12 of the bat 10 and encapsulate the fibers 16 and 17. The preferred overlay 14 consists of a 50:50 ratio of carbon and aramid fibers with the fibers alternating in radial-sequence as shown in FIG. 2. Alternatively, a plurality of strands of carbon fiber could alternate with a plurality of strands of aramid fiber. The preferred AS4 carbon fibers have a tensile strength of 450,000 PSI, a modulus of elasticity of 32 million PSI, and an elongation at break of 125%. The preferred aramid fibers, Kevlar 49 made by DuPont, have a tensile strength of 525,000 PSI, a modulus of elasticity of 18 million PSI, and an elongation at break of 440%. The combination of carbon and aramid fibers provide an overlay with a modulus of elasticity of approximately 25 million PSI, substantially greater than the modulus of elasticity of the bat without an overlay. The modulus of elasticity of ash is approximately 2.8 million PSI. The high modulus of elasticity of the carbon fibers is enhanced by the very high elongation at break of the aramid fibers. It is believed that this combination of fibers will strengthen a bat so it does not break. However, if a bat were to break, it is believed that the very high elongation at break characteristics of the aramid fiber will hold the broken portion to the handle so that is does not fly away.

The fibers 16 and 17 of the overlay member 14 are preferably biaxially braided at a 45 degree±15 degree angle to the longitudinal axis. Longitudinal fibers oriented parallel to the longitudinal axis of the bat may also be incorporated into the braid if desired. The natural lay of the hybrid overlay member is a double-bias orientation which places the alternating strands at a relationship of ±45 degrees to the longitudinal axis and approximately 90 degrees to each other. The overlay member when applied to the bat conforms to the varying diameter of the wood bat with a pattern that in the narrow cross section of the handle area positions the fibers at a degree of orientation closer to the longitudinal axis of the bat, namely ±30 degrees. This adds to the beam-strength of the bat. The closer the fibers are to being parallel to the longitudinal axis of the bat, the greater the strength added to the bat. Where the overlay envelopes the larger cross section of the barrel, the orientation of the fibers approaches approximately ±60 degrees This provides more integrity or hoop strength in the barrel which strengthens the barrel portion of a bat.

It is to be understood that the tubular braided overlay 14 described herein of double bias fiber orientation is a conformable or flexible structure which can be extended to increase its length and decrease its diameter, or can be compressed to decrease its length and increase its diameter. In its natural lay-flat state, the fiber orientation rests at ±45 degrees. When applied as an overlay over the handle of a bat, the tubular braid will conform to the specific and varying diameter of the bat such that where the handle diameter is less than the lay-flat diameter of the braided member, the fiber orientation moves more towards the longitudinal axis or 0 degrees. Conversely, as the handle diameter increases to greater than the lay-flat diameter of the braided member, fiber orientation moves toward 90 degrees or transverse. Any bias angles within the range of 45 degrees ±15 are acceptable.

Figure 3:
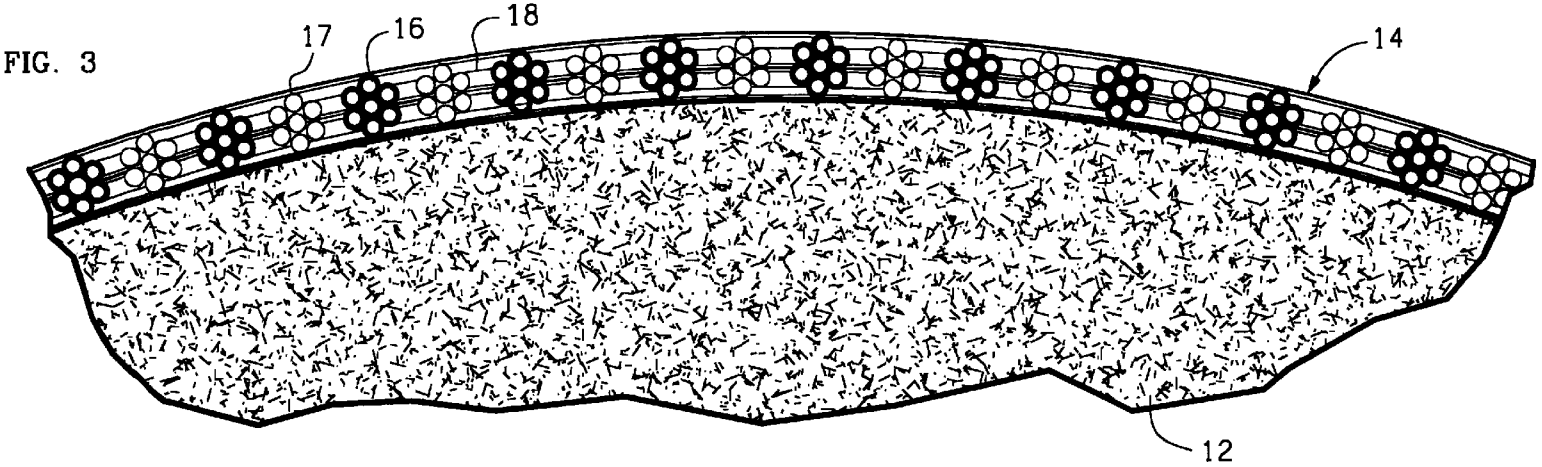
FIG. 3 is a cross section of the overlay member on wood showing the carbon and aramid fibers and the resin matrix.

Referring to FIG. 3, there is shown a cross section of the handle 12 of the bat 10 with the overlay member 14 laminated thereto. The carbon fibers shown in black are designated as 16, and the aramid fibers shown in white are designated as 17. Preferably the strands of carbon fibers 16 and aramid fibers 17 alternate as a 50:50 fiber ratio. The resin matrix 18 is shown between the fibers. A layer of resin matrix 18 also coats most of the grip portion of the bat 12.

Figure 4:
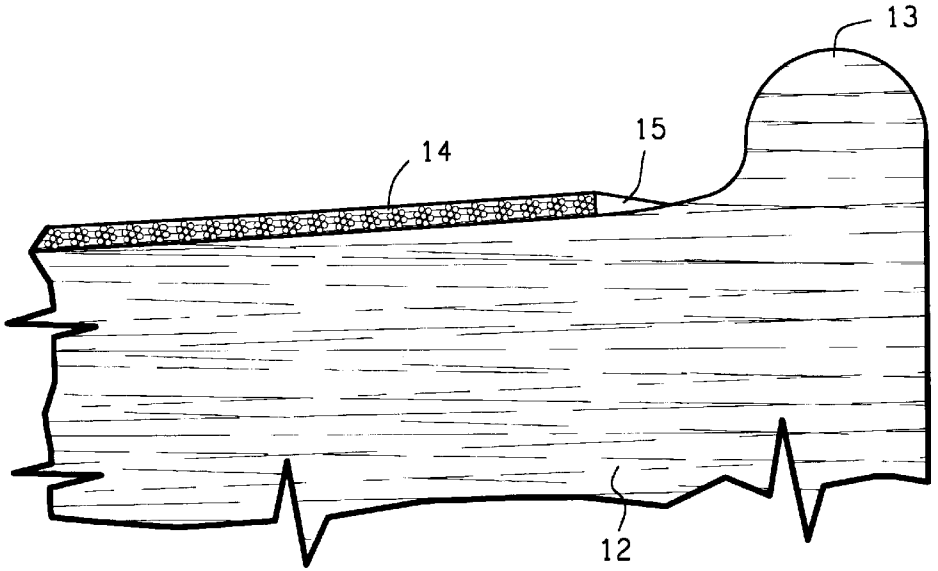
FIG. 4 is an exploded cross-sectional view of the end of the bat illustrating the polymer fillet at the end of the overlay member.

To manufacture a bat in accordance with the principles of this invention, a tubular overlay member 14 is cut to size and is compressed longitudinally so that its diameter enlarges. It is then slid over the knob 13 of the bat until it is entirely on the grip portion 12. One end of the overlay member 14 is placed close to or abutting the knob 13. The member 14 is then smoothed down by hand until it conforms to the surface of the handle 12. Alternatively, the braided overlay member 14 may be pulled onto the bat without cutting it first. The braid is then smoothed out by hand and is then cut near the knob of the bat. A thermosetting resin matrix material 18 is then applied to the member 14 and is forced down through the interstices of the braid so that it contacts the handle 12. Either epoxy/amine, epoxy/anhydride or bisphenol-A resin systems can be used. It is preferred that an epoxy/amine system be used for the subject invention. The thermosetting matrix 18 is applied evenly over the entire braided member enough to saturate through to the handle 12, but without running or dripping. The resin is worked into the interstices of the braided overlay member 14 and the excess material is squeezed towards the knob 13. Excess resin is removed from the overlay member and discarded. If the braided overlay member 14 moves during the application of resin, it can be readjusted to position one end thereof as close as possible to the knob 13. The resin material 18 is applied uniformly into the braid so that any voids or air pockets are removed during this process. The barrel 11 of the bat and the knob 13 should be wiped with acetone to remove any excess resin from those portions of the bat before curing. The bat is then placed into a curing oven to cure for an appropriate period, approximately 10 to 15 minutes at 160 degrees to 180 degrees Fahrenheit with an epoxy/amine system. The braided overlay member 14 is preferably trimmed on both ends after the bat is removed from the oven, but before the resin material cures too far to make trimming difficult or impossible. Using a sharp clean razor knife, approximately ¼ inch of braided overlay member is trimmed from the knob end 13 to provide a neat appearance. The barrel end is also trimmed so that the tubular overlay member is no more than 18 inches nor less than 15 inches from the knob 13. A liquid polymer fillet 15 is applied to each end of the overlay member 14 to fair the end smoothly onto the bat as shown in FIG. 4. The barrel portion 11 of the bats may be lacquer coated at this point. The cured bats are then preferably placed vertically into a storage box to complete the resin cure at room temperature for approximately 8 hours. This room temperature cure can be replaced with a secondary oven cure to speed up the cure cycle. The surface of the cured overlay member 14 can be sanded if desired, but preferably is left unsanded to provide a roughened surface which is desired by the batters. The composite overlay of this invention may be used on bats that are solid or laminated with equal results.

Figure 5:
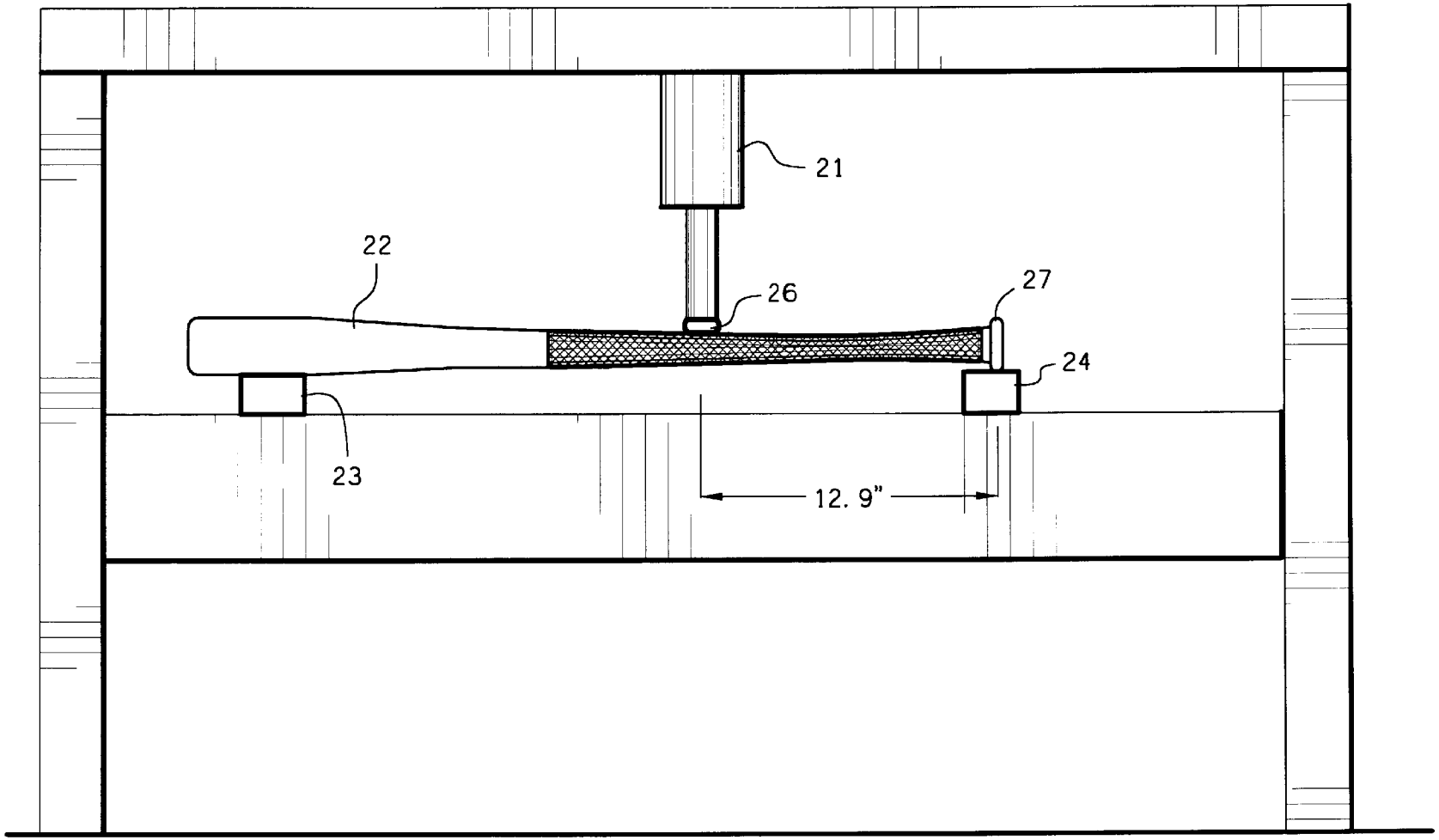
FIG. 5 is a side view illustrating a test apparatus for applying force to a bat.

Referring to FIG. 5 there is shown a test set up wherein a number of bats with various types of overlay materials were tested to determine the peformance of each overlay material.

A number of Hoosier type 215 bats of 33 inch length were utilized. The handle of each bat was laminated with a different overlay material using an epoxy/amine resin system No. 1314/No. 3102 hardener in a ratio of 4:1 from Jeffco Products in San Diego, Calif. Two bats without reinforcing overlays were used to establish a standard. Two bats were made with a overlay of an "E" type glass fiber braid. Two bats were made with an overlay of all aramid fiber braid. Two bats were made with a braided overlay of all AS4 carbon fiber. Two bats were made in accordance with the principles of this invention using a hybrid braid of 50% AS4 carbon and 50% Kevlar-49 type aramid in a balanced biaxial weave. As shown in FIG. 5, a hydraulic press 21 with a capacity of 30 tons was utilized. A test bat 22 was placed between two steel supports 23 and 24. The end 26 of the hydraulic press was placed at a point 12.9 inches from the knob 27. The hydraulic press was activated and the ram 26 was brought down until failure of the bat. At the point of failure, the vertical travel of the ram 26 was measured from its starting point. The table below shows the deflection in inches and the force in pounds necessary to cause breakage of the bat.

| SPECIMEN | DEFLECTION IN INCHES | PSI | FORCE IN POUNDS |
|---|---|---|---|
| Plain Wood Bat | 2.17 | 42 | 825 |
| Bat with Fiberglass Fiber Overlay | 2.69 | 52 | 1021 |
| Bat with Carbon Fiber Overlay | 3.06 | 60 | 1178 |
| Bat with Aramid Fiber Overlay | 3.56 | 59 | 1158 |
| Bat with Hybrid: Carbon/Aramid Fiber Overlay | 5.19 | 89 | 1747 |

It is to be noted that the hybrid overlay member comprising carbon fiber and aramid fibers required a deflection of more than twice the deflection in the plain wood bat before catastrophic failure, and required a force of more than double that required to break the plain wood bat. Similarly, the bat with the hybrid overlay required significantly more force than either the all fiberglass, all carbon or all aramid overlay.

The plain wood bats failed catastrophically upon application of 42 PSI or a force of 825 pounds. The bat with the fiberglass overlay failed in three stages. First, the upper area of the overlay failed in progressive compression outwardly from the ram. Second, the wood core failed at the elastic limit and began to rupture. Third, the bottom portion of the overlay failed in tension and the entire section failed catastrophically at still a much higher load limit.

The carbon overlay bat failed catastrophically at its elastic limit with a complete rupture of the bottom portion and a simultaneous, but minute, compressive failure at the upper load point. The bat with the aramid overlay failed in exactly the same manner as the fiberglass, namely the three stage classic failure. The compressive strength of aramid fiber is less than the "E" type glass fiber and failed accordingly.

The hybrid overlay bat of 50% carbon fiber and 50% aramid fiber failed at a load of more than twice that of the plain wood bats and failed at an extreme elastic limit with no premature compressive failure on the uppermost side and with a noticeably less degree of tension rupture on the lowermost side. It is to be noted that both the carbon overlay bats and the aramid overlay bats failed at loads significantly less than that of the hybrid overlay.

In comparing the data in the table, the fiberglass overlay bat was 1.24 times as strong as the plain wood bat. The carbon fiber overlay bat was 1.4 times as strong as the plain wood bat. The aramid fiber overlay bat was 1.64 times as strong as the plain wood bat not counting the premature, compressive failure in the upper portion. The hybrid overlay bat was 2.39 times as strong as the wood bat.

This test data also illustrates that the modulus of elasticity of the bat with the hybrid overlay is significantly greater than the modulus of elasticity of the plain bat. The modulus of elasticity for ash wood, kiln dried to a moisture content of 12% is 2.8 million PSI in accordance with the Standard Handbook for Mechanical Engineers, Baumeister and Marks, 1964, section 6-151. It is estimated that the modulus of elasticity of the bat reinforced with the carbon/aramid overlay is more than double the modulus of elasticity of the plain wood bat. This increase in the modulus of elasticity allows the greater deflection in the bat before breaking.

Although the present invention has been described with reference to a baseball bat, the tubular hybrid composite braided member may be used for strengthening other objects as well. For example, it may be used to strengthen the handles of sledge hammers, hammers, axes and other hand held tools subject to impact. The tubular braided reinforcing member may also be applied to sailboat masts to significantly strengthen the masts. It can be used on wood, metal, composite and other masts. The tubular braided member may also be applied to bicycle frames, particularly mountain bikes which are subjected to high impact forces, to the frames of ultralights, to the frames of exercise equipment, and to other equipment having tubular members which require strengthening. It may also be used on the shafts of golf clubs.

Although the present invention has been described in the terms of certain preferred embodiments and exemplified with respect thereto, one skilled in the art will readily appreciate the various modifications, changes, omissions and substitutions that may be made without departing from the spirit and the scope thereof It is intended that the present invention be limited solely by the scope of the following claims.

I claim:

1. A baseball bat comprising:

a wood bat having a hitting portion and a handle portion with a knob formed on the end of the handle portion;

a tubular biaxial braided overlay member laminated to the handle portion of said bat, said overlay member comprising a hybrid of carbon fibers and aramid fibers for strengthening the bat and for providing an enhanced gripping surface, and said member having a modulus of elasticity substantially greater than the modulus of elasticity of the wood bat.

2. A baseball bat as set forth in claim 1 wherein the overlay member is formed with a substantially equal number of carbon fibers and aramid fibers.

3. A baseball bat as set forth in claim 1 wherein the overlay member is formed with alternating strands of carbon fibers and aramid fibers.

4. A baseball bat as set forth in claim 1 wherein the overlay member is formed with a plurality of strands of carbon fiber alternating with a plurality of strands of aramid fibers.

5. A baseball bat as set forth in claim 1 wherein the overlay member is laminated with a thermosetting resin matrix to the handle portion of the bat.

6. A baseball bat as set forth in claim 5 wherein the interstices between fibers of the tubular braided overlay member are substantially filled with the thermosetting resin matrix.

7. A baseball bat as set forth in claim 5 wherein the thermosetting resin matrix is cured.

8. A baseball bat as set forth in claim 6 wherein the thermosetting resin matrix is cured.

9. A baseball bat as set forth in claim 5 wherein said thermosetting resin matrix is an epoxy system.

10. A baseball bat as set forth in claim 9 wherein said thermosetting resin matrix is an epoxy-amine system.

11. A baseball bat as set forth in claim 1 wherein the modulus of elasticity of the bat having the overlay laminated thereto is substantially greater than the modulus of the wood bat itself.

* * * * *